US006991467B1

(12) United States Patent
Cheng et al.

(10) Patent No.: US 6,991,467 B1
(45) Date of Patent: Jan. 31, 2006

(54) ADJUSTABLE ELECTRIC ADAPTOR

(75) Inventors: Shih-Sheng Cheng, Taipei (TW); Wen-Chiuan Lin, Taipei (TW)

(73) Assignees: Union Power Information Ind. Co., Ltd., Taipei (TW); Union-P Technology Co., Ltd., Taipei (TW)

( * ) Notice: Subject to any disclaimer, the term of this patent is extended or adjusted under 35 U.S.C. 154(b) by 0 days.

(21) Appl. No.: 10/953,252

(22) Filed: Sep. 28, 2004

(51) Int. Cl.
*H01R 41/00* (2006.01)

(52) U.S. Cl. ..... 439/10; 439/6; 439/640

(58) Field of Classification Search ..... 439/10, 439/11, 6, 8, 9, 31, 640, 954
See application file for complete search history.

(56) References Cited

U.S. PATENT DOCUMENTS

| | | | | |
|---|---|---|---|---|
| 6,394,813 | B1 * | 5/2002 | Stout et al. | 439/11 |
| 6,544,075 | B1 * | 4/2003 | Liao | 439/638 |
| 6,612,874 | B1 * | 9/2003 | Stout et al. | 439/640 |
| 6,695,620 | B1 * | 2/2004 | Huang | 439/11 |
| 6,722,892 | B1 * | 4/2004 | Blakelock | 439/31 |
| 6,733,329 | B2 * | 5/2004 | Yang | 439/518 |
| 6,786,734 | B2 * | 9/2004 | Yu | 439/11 |
| 6,786,743 | B2 * | 9/2004 | Huang | 439/131 |
| 6,893,267 | B1 * | 5/2005 | Yueh | 439/8 |
| 2004/0105329 | A1 * | 6/2004 | Lin et al. | 365/202 |

* cited by examiner

*Primary Examiner*—Ross Gushi
(74) *Attorney, Agent, or Firm*—Pro-Techtor Int'l Services

(57) ABSTRACT

An adjustable electric adaptor includes a first connecting member, a second connecting member including an end pivotally connected to an inner end of the first connecting member, a first connector securely mounted in an outer end of the first connecting member, and a second connector including an electrically insulating housing. A tubular section extends from the electrically insulating housing and through a central hole of the second connecting member. The second connector is electrically connected to the first connector by a cable that extends through the tubular section. The second connector is pivotable about a central axis of the central hole of the second connecting member relative to the first connector. The first connector and the second connector are pivotable relative to each other about an axis orthogonal to the central axis of the central hole of the second connecting member.

2 Claims, 9 Drawing Sheets

ADJUSTABLE ELECTRIC ADAPTOR

BACKGROUND OF THE INVENTION

1. Field of the Invention

The present invention relates to an electric adaptor. In particular, the present invention relates to an electric adaptor providing electrical connection between two electric appliances.

2. Description of the Related Art

Various electric appliances such as computer displays, laptops (or notebooks), digital cameras, etc include a plurality of connecting ports to allow inter-electrical connection with one another by an electric adaptor. A typical electric adaptor includes two connectors respectively on two ends thereof for connecting with associated ports of two electric appliances. However, the connectors of the conventional electric adaptors are fixed, not allowing adjustment in response to the space in which the electric appliances are mounted.

SUMMARY OF THE INVENTION

In accordance with an aspect of the present invention, an adjustable electric adaptor comprises a first connecting member, a second connecting member including an end pivotally connected to an inner end of the first connecting member, a first connector securely mounted in an outer end of the first connecting member, and a second connector including an electrically insulating housing. A tubular section extends from the electrically insulating housing and through a central hole of the second connecting member. The second connector is electrically connected to the first connector by a cable that extends through the tubular section.

The second connector is pivotable about a central axis of the central hole of the second connecting member relative to the first connector. The first connector and the second connector are pivotable relative to each other about an axis orthogonal to the central axis of the central hole of the second connecting member.

In an embodiment of the invention, each of the first connecting member and the second connecting member includes two half casings. The end of the second connecting member includes two pivotal sections each having a pin extending outward along a direction orthogonal to the tubular section. The inner end of the first connecting member includes two pivotal sections each having a pin hole through which an associated one of the pins extend. The first connecting member further includes two stepped holes respectively adjacent to the pin holes. A tightening ring is mounted around each pin and fittingly received in an associated one of the stepped holes. The first connecting member further includes two annular grooves respectively adjacent to the pin holes. Each pin includes an enlarged head on a distal end thereof. The enlarged head of each pin is fittingly received in an associated one of the annular grooves.

The tubular section includes a flange on a distal end thereof. The flange includes a protrusion. The second connecting member includes a stop, allowing rotation of the second connecting member relative to the first connecting member about the central axis of the tubular section until the protrusion abuts against the stop.

The first connector and the second connector are two USB connectors of different specifications.

Other objectives, advantages, and novel features of the invention will become more apparent from the following detailed description when taken in conjunction with the accompanying drawings.

DETAILED DESCRIPTION OF THE PREFERRED EMBODIMENTS

Figure 1:
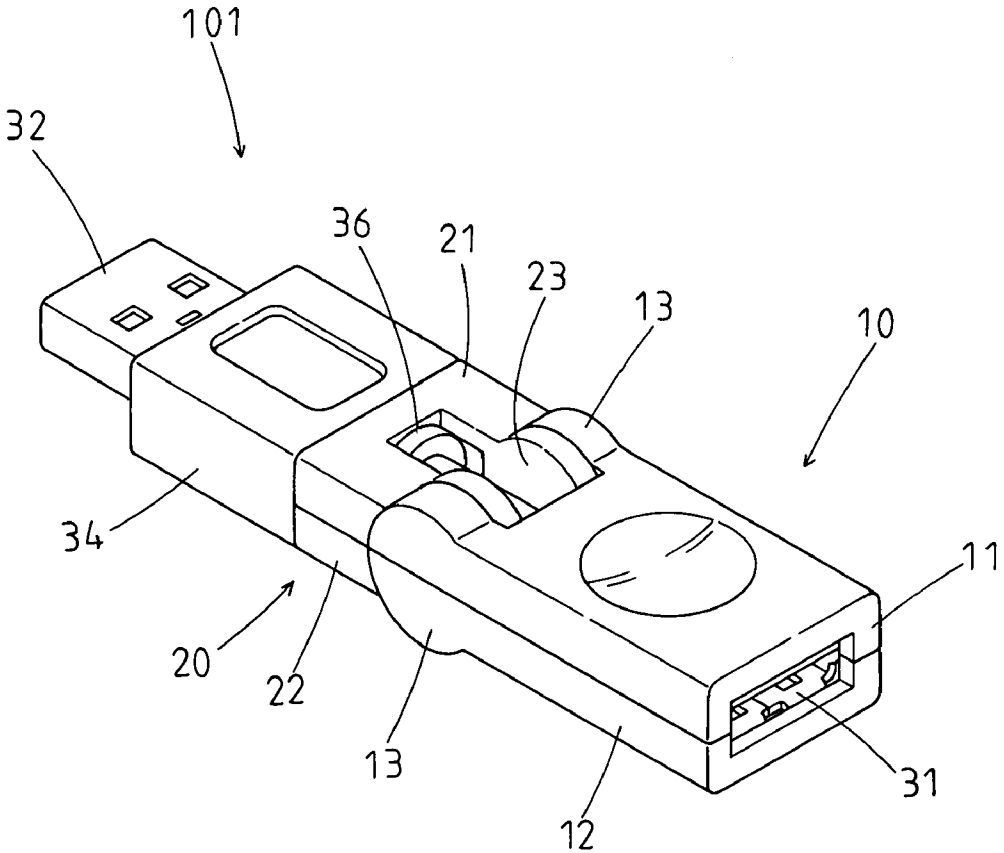
FIG. 1 is a perspective view of an adjustable electric adaptor in accordance with the present invention.
Figure 2:
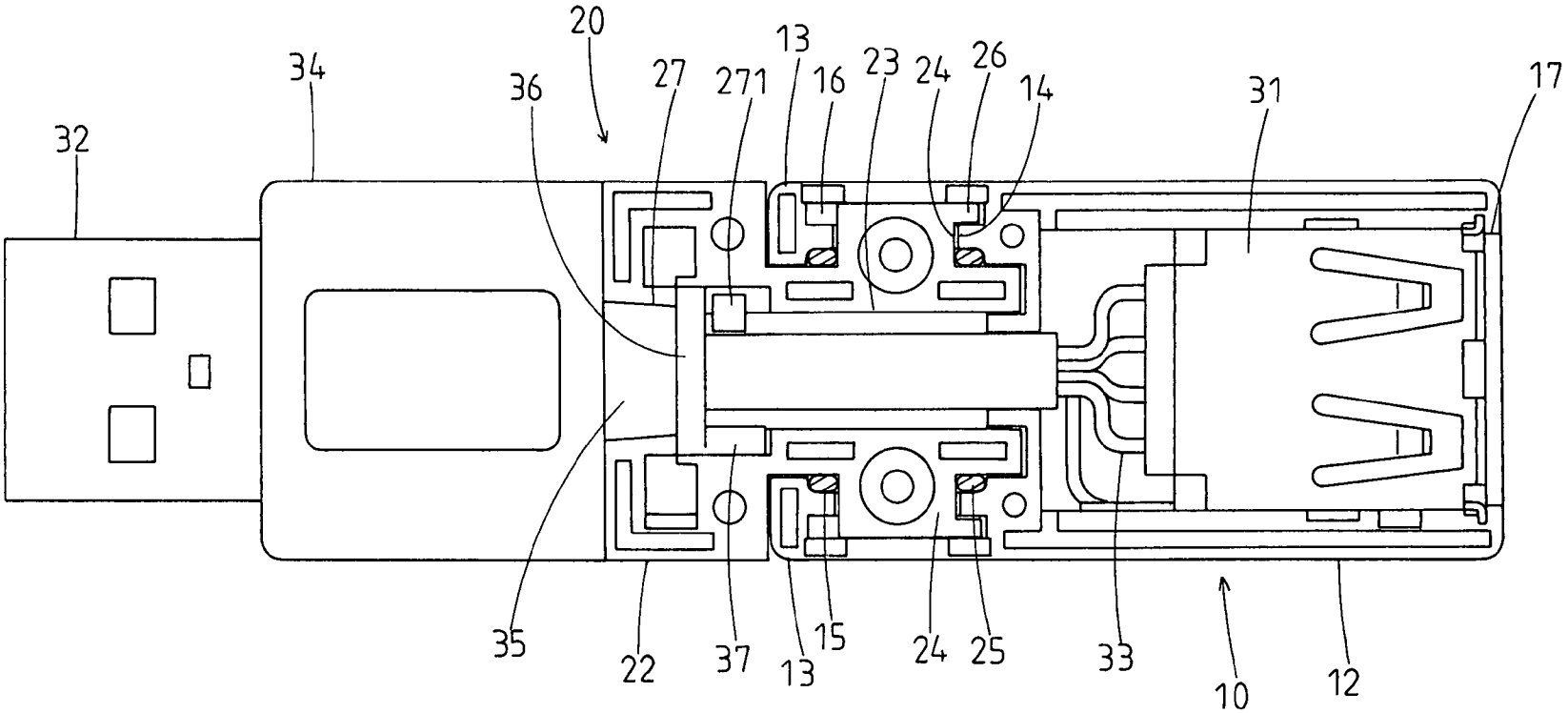
FIG. 2 is a top view illustrating interior structure of the adjustable electric adaptor in accordance with the present invention.
Figure 3:
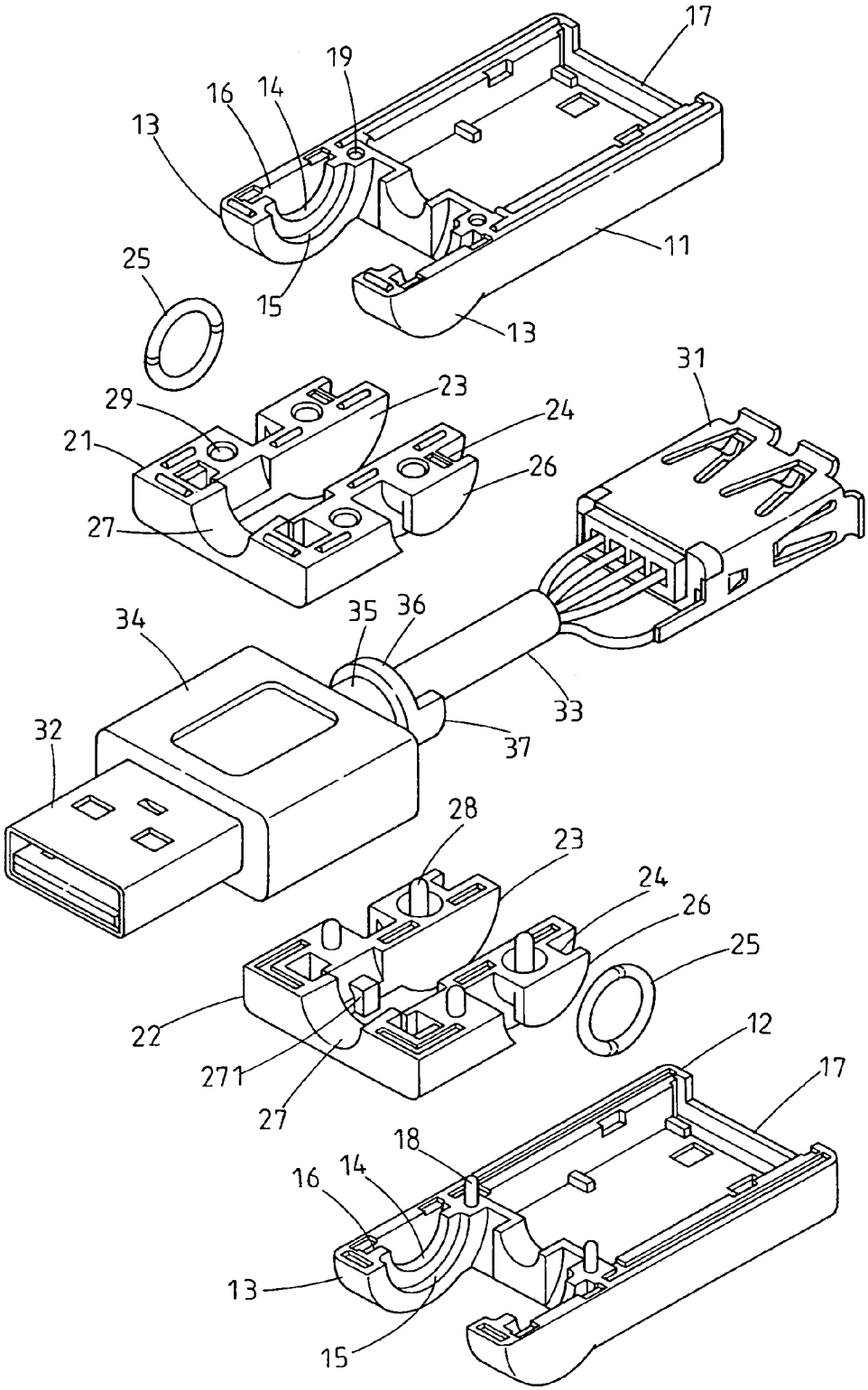
FIG. 3 is an exploded perspective view of the adjustable electric adaptor in accordance with the present invention.

Referring to FIGS. 1 through 3, an adjustable electric adaptor 101 in accordance with the present invention comprises a first connecting member 10, a second connecting member 20, a first connector 31, and a second connector 32. The first connecting member 10 includes an inner end pivotally connected to an inner end of the second connecting member 20. The first connector 31 is mounted to an outer end of the first connecting member 10 and the second connector 32 is mounted to an outer end of the second connecting member 20.

In this embodiment, the first connecting member 10 includes two half casings 11 and 12, wherein the half casing 11 includes holes 19 and the half casing 12 includes pegs 18 for engaging with the holes 19, thereby assembling the half casings 11 and 12 together. Similarly, the second connecting member 20 includes two half casings 21 and 22, wherein the half casing 21 includes holes 29 and the half casing 22 includes pegs 28 for engaging with the holes 29, thereby assembling the half casings 21 and 22 together. After assembly, the first connecting member 10 includes an inner space and an opening 17 in the outer end thereof. The second connecting member 20 includes a central hole 27.

The inner end of the first connecting member 10 includes two pivotal sections 13 on two sides thereof and the inner end of the second connecting member 20 includes two pivotal sections 23 on two sides thereof. Each pivotal section 23 of the second connecting member 20 includes a pin 24 extending through a pin hole 14 in an associated pivotal section 13. A tightening ring 25 is mounted around each pin 24 and fittingly received in an associated stepped hole 15 adjacent to an associated pin hole 14. Thus, the first connecting member 10 and the second connecting member 20 may pivot relative to each other while having a retaining effect therebetween.

The first and second connectors 31 and 32 are USB connectors of different specifications. Further, the first connector 31 and the second connector 32 are interconnected by a cable 33 so that a coupling end of each of the first and the second connectors 31 and 32 faces outward. The first connector 31 is mounted in the inner space of the first connecting member 10. An electrically insulating housing 34 is formed on an end of the second connector 32 and a tubular section 35 extends from an end face of the electrically insulating housing 34 through the central hole 27 of the second connecting member 20. The cable 33 extends through the tubular section 35.

Figure 4:
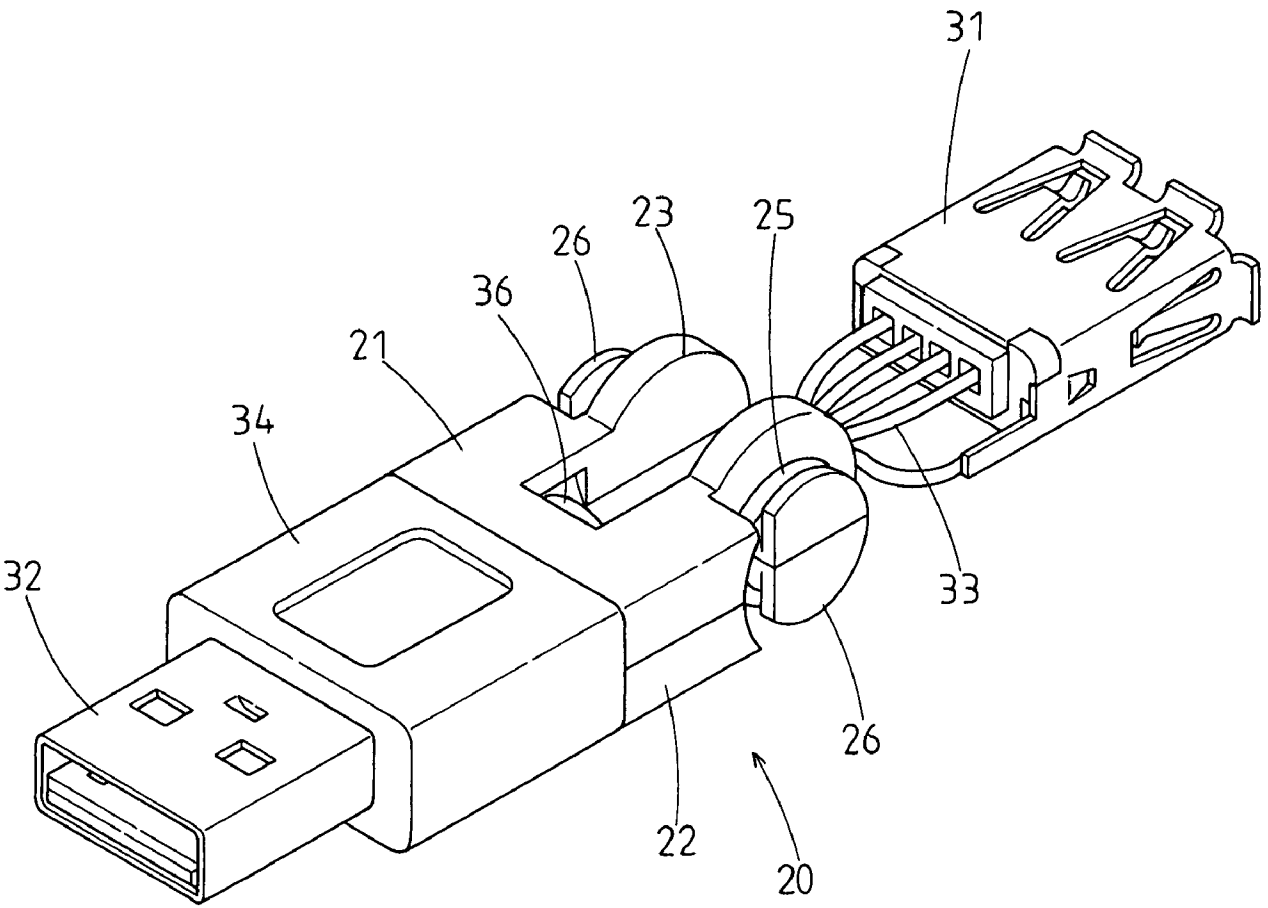
FIG. 4 is a perspective view of the adjustable electric adaptor that is partly assembled.

In assembly, the tubular section 35 of the second connector 32 is received in the central hole 27 of the half casings 21 and 22 that are subsequently bonded together by supersonic welding, as shown in FIG. 4. A tightening ring 25 is mounted around each pin 24 of the second connector 20, as mentioned above. In a preferred embodiment, an enlarged head 26 is formed on a distal end of each pin 24 at a position adjacent to a distal end of the tubular section 35, preventing the first connecting member 10 from being disengaged from the second connecting member 20. In a preferred embodiment, the enlarged head 26 on the distal end of each pin 24 is fittingly received in an annular groove 16 adjacent to the associated pin hole 14.

The pivotal sections 13 and the pin holes 14 of the half casings 11 and 12 together receive pins 24 of the second connecting member 20, with the first connector 31 being positioned in the inner space of the first connecting member 10. As illustrated in FIGS. 2 through 4, the pins 24 of the second connecting member 20 are pivotally received in the pin holes 14 of the first connecting member 10, with the tightening rings 25 tightly received in the stepped holes 15 adjacent to the pin holes 14.

Figure 7:
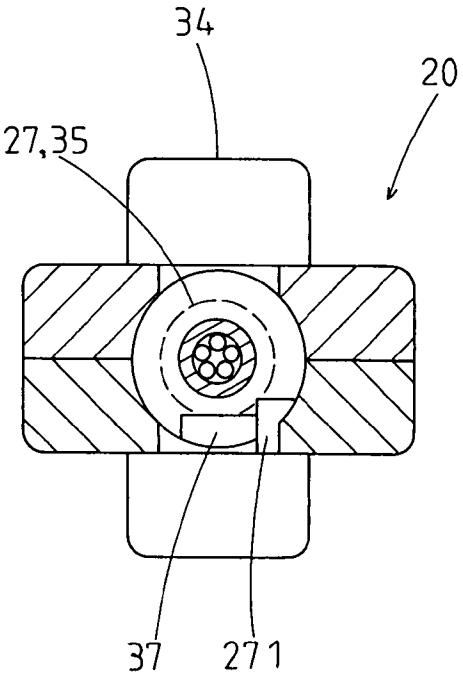
FIG. 7 is a view similar to FIG. 5, wherein the second connector of the adjustable electric adaptor is turned counterclockwise through 90 degrees.
Figure 6:
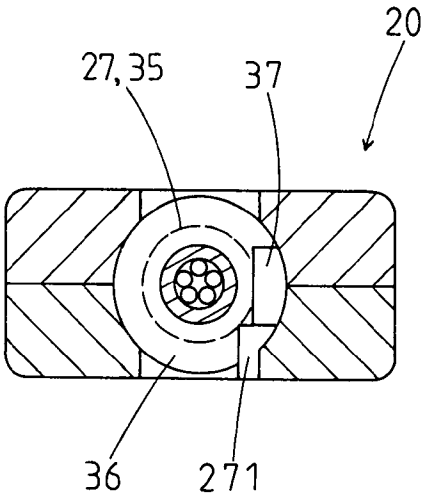
FIG. 6 is a view similar to FIG. 5, wherein a second connector of the adjustable electric adaptor is turned clockwise through 180 degrees.
Figure 5:
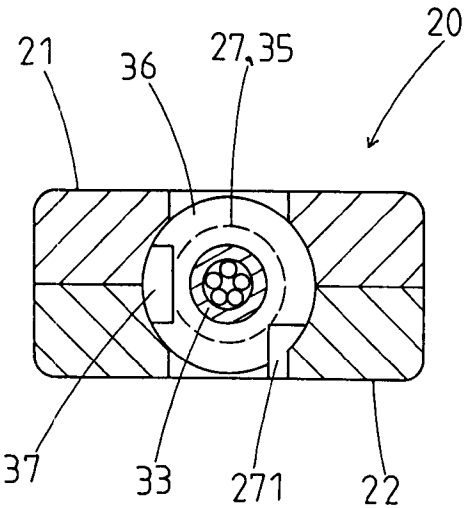
FIG. 5 is a sectional view of the adjustable electric adaptor.

The second connector 32 is rotatable about a central axis of the tubular section 35 that is coincident with a central axis of the central hole 27 of the second connecting member 20. In a preferred embodiment, the tubular section 35 includes a flange 36 with a protrusion 37, and the second connecting member 20 includes a stop 271 adjacent to the central hole 27. The flange 36 prevents the second connector 32 from being disengaged from the second connecting member 20. Further, rotational movement of the tubular section 35 (i.e., the whole second connector 32) relative to the first connector 31 is limited by the stop 27. More specifically, the tubular section 35 can be turned from a position shown in FIG. 5 through 180 degrees in a clockwise direction until the protrusion 37 of the tubular section 35 is stopped by the stop 271, as shown in FIG. 6. Further, the tubular section 35 can be turned from a position shown in FIG. 6 through 90 degrees in a counterclockwise direction until the protrusion 37 of the tubular section 35 is stopped by the stop 271, as shown in FIG. 7. This avoids damage to the cable 33 resulting from excessive rotation of the second connector 32.

Figure 8:
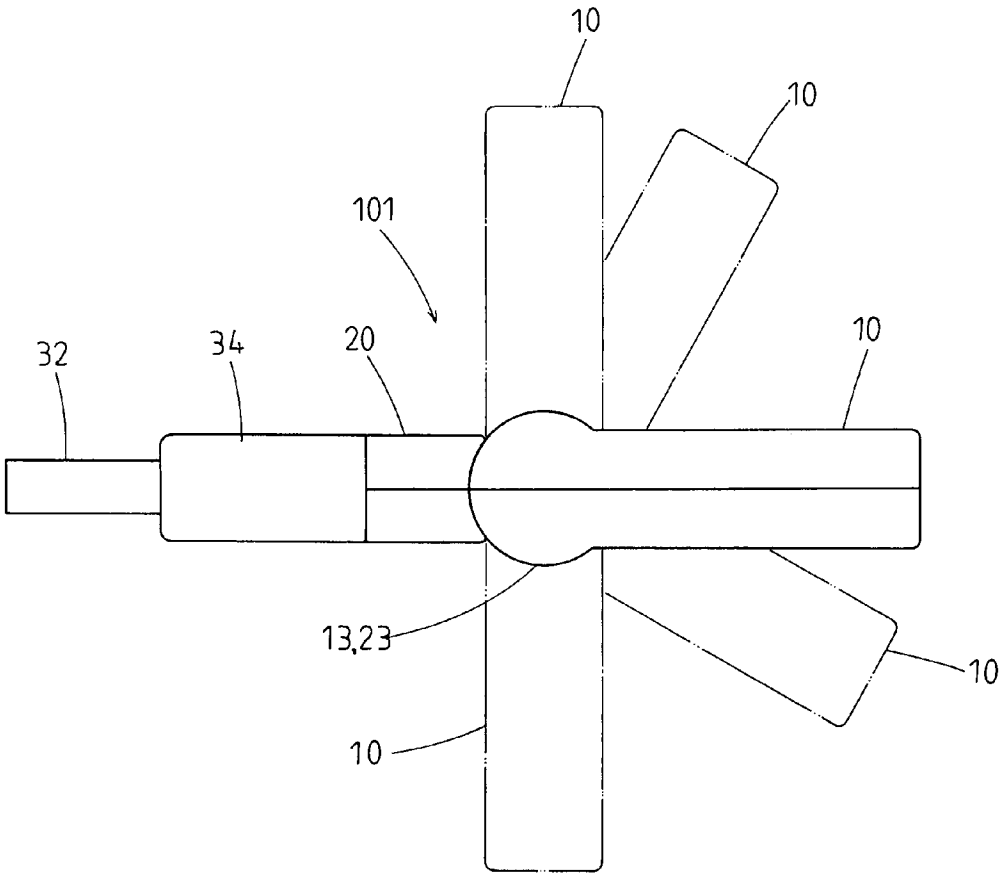
FIG. 8 is a side view showing pivotal adjustment of a first connecting member relative to the second connector.

Further, the first connecting member 10 and the second connecting member 20 can be pivoted through 180 degrees relative to each other, allowing adjustment of relative angular position therebetween. In other words, the first connector 31 and the second connector 32 can be pivoted relative to each other through 180 degrees about an axis orthogonal to the central axis of the tubular section 35, as shown in FIG. 8.

Figure 9:
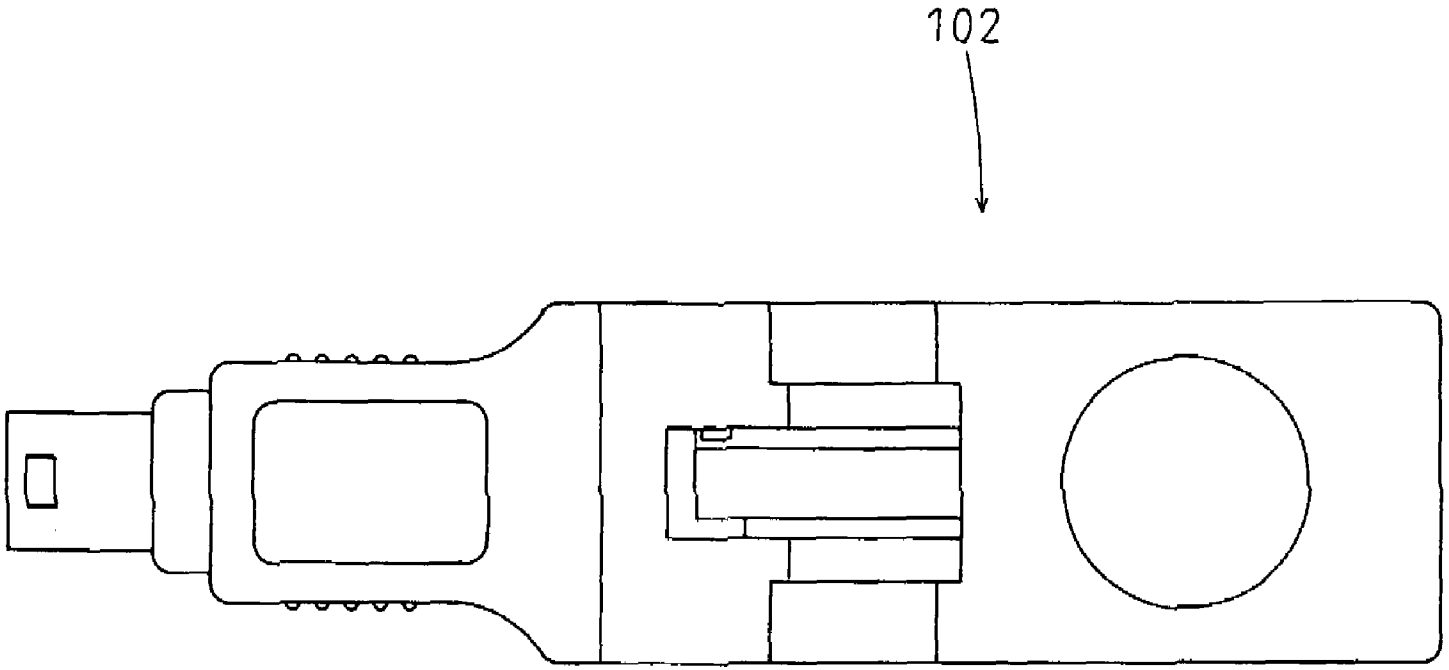
FIG. 9 is a top view of a modified embodiment of the adjustable electric adaptor.
Figure 10:
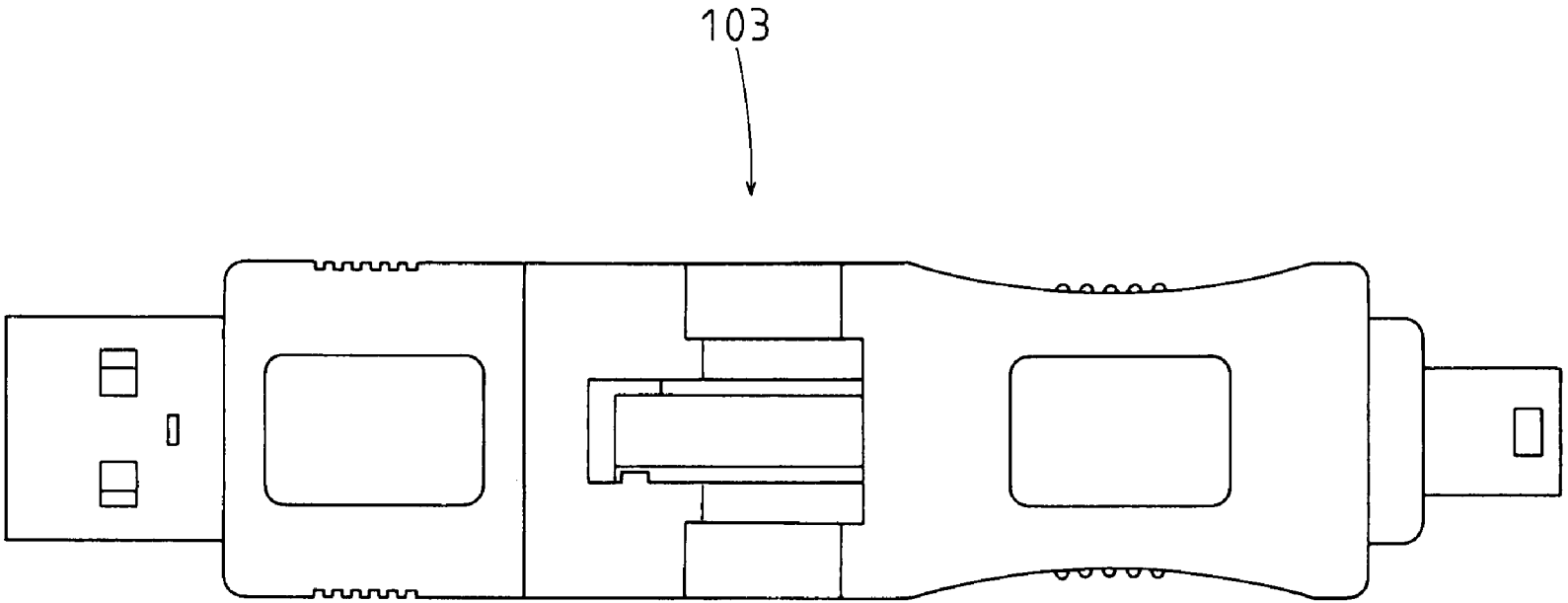
FIG. 10 is a top view of another modified embodiment of the adjustable electric adaptor.
Figure 11:
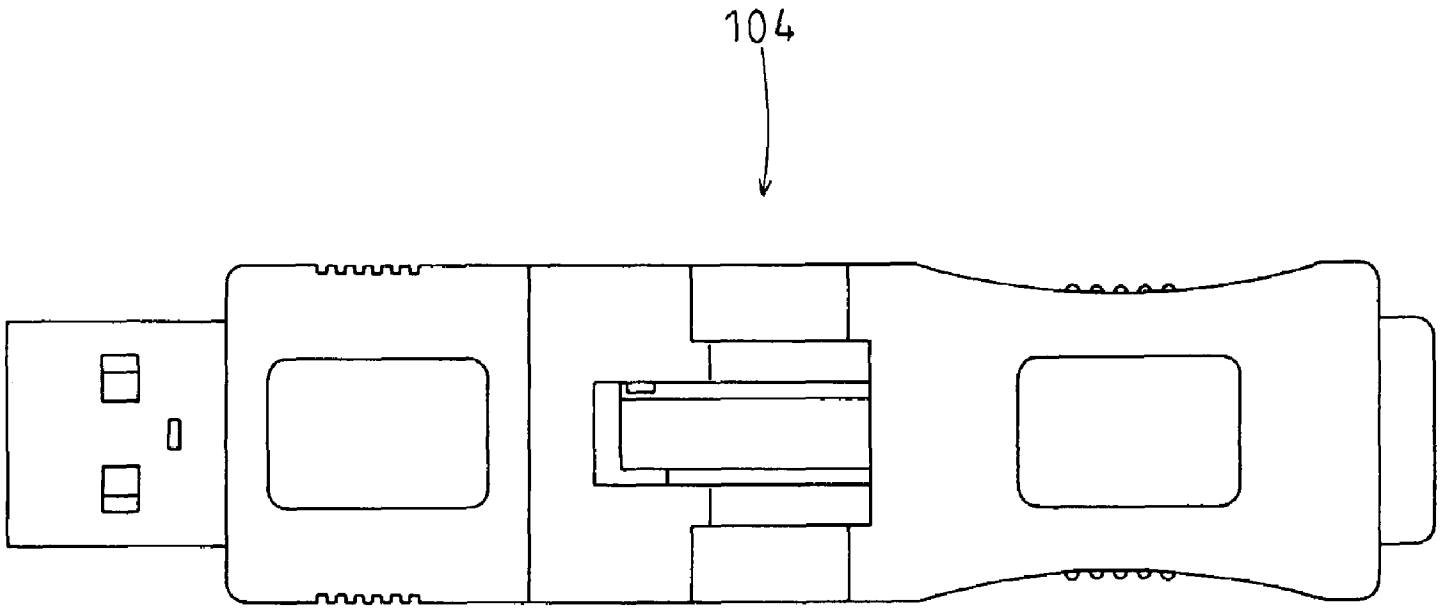
FIG. 11 is a top view of a further modified embodiment of the adjustable electric adaptor.

FIGS. 9 through 11 illustrate adjustable electric adaptors 102, 103, and 104 for coupling two connectors of different specifications.

Although specific embodiments have been illustrated and described, numerous modifications and variations are still possible without departing from the essence of the invention. The scope of the invention is limited by the accompanying claims.

What is claimed is:

1. An adjustable electric adaptor comprising:

a first connecting member including an inner end and an outer end;

a second connecting member including an end pivotally connected to the inner end of the first connecting member, the second connecting member including a central hole;

a first connector securely mounted in the outer end of the first connecting member; and a second connector including an electrically insulating housing, a tubular section extending from the electrically insulating housing and through the central hole of the second connecting member, the second connector being electrically connected to the first connector by a cable that extends through the tubular section;

the second connector being pivotable about a central axis of the central hole of the second connecting member relative to the first connector;

the first connector and the second connector being pivotable relative to the other about an axis orthogonal to the central axis of the central hole of the second connecting member;

wherein the end of the second connecting member includes two pivotal sections each having a pin extending outward along a direction orthogonal to the tubular section, the inner end of the first connecting member including two pivotal sections each having a pin hole through which an associated one of the pins extend, the first connecting member further including two stepped holes respectively adjacent to the pin holes, a tightening ring being mounted around each said pin and fittingly received in an associated one of the stepped holes.

2. The adjustable electric adaptor as claimed in claim 1 wherein the first connecting member further includes two annular grooves respectively adjacent to the pin holes, each said pin including an enlarged head on a distal end thereof, the enlarged head of each pin being fittingly received in an associated one of the annular grooves.

* * * * *